US006402364B1

(12) United States Patent
Esclar et al.

(10) Patent No.: US 6,402,364 B1
(45) Date of Patent: Jun. 11, 2002

(54) PORTABLE DISPENSER FOR PACKAGING AND DISPENSING COLORED COSMETICS

(75) Inventors: Dominique Esclar, Herpy L'Arlesienne; Johan Aubert, Clichy, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/536,473

(22) Filed: Mar. 28, 2000

(30) Foreign Application Priority Data

Apr. 2, 1999 (FR) ..... 99 04152

(51) Int. Cl.[7] ..... B01F 15/04

(52) U.S. Cl. ..... 366/160.4; 366/189; 366/195; 366/276; 366/333; 366/172.1; 222/135; 222/145.6

(58) Field of Search ..... 366/172.1, 143, 366/605, 160.4, 189, 182.1, 182.2, 182.3, 182.4, 195, 267, 332, 333, 154.1, 276; 222/159, 134, 132, 135, 142, 145.6, 145.2, 145.5, 144

(56) References Cited

U.S. PATENT DOCUMENTS 3,030,329 A * 4/1962 Warnsdorfer et al.
3,228,662 A * 1/1966 Morshauser et al.
3,390,121 A * 6/1968 Burford et al.
3,390,814 A * 7/1968 Creighton, Jr. et al.
3,670,785 A * 6/1972 Heiss et al.
3,843,099 A * 10/1974 Duncan
4,101,055 A * 7/1978 Poitras
4,432,469 A 2/1984 Eble et al.
4,460,719 A * 7/1984 Danville
4,494,677 A * 1/1985 Falcoff
4,509,861 A * 4/1985 Sjonell
4,668,097 A * 5/1987 Nygren et al.
4,676,655 A * 6/1987 Handler
4,871,262 A * 10/1989 Krauss et al.
4,889,432 A * 12/1989 Patterson
4,946,100 A * 8/1990 Flemming et al.
5,474,211 A * 12/1995 Hellenberg
6,089,408 A * 7/2000 Fox ..... 222/144
6,202,895 B1 * 3/2001 Fox ..... 222/144

FOREIGN PATENT DOCUMENTS

DE 296 02 244 U1 7/1996
DE 196 47 617 A1 5/1998
EP 0 313 519 A1 4/1989
WO WO 99/04893 2/1999

* cited by examiner

*Primary Examiner*—Tony G. Soohoo
(74) *Attorney, Agent, or Firm*—Oliff & Berridge, PLC

(57) ABSTRACT

A portable dispenser has at least two containers organized to enable the substances they contain to be dispensed in proportions selected by the user, and a mixing chamber into which the substances contained in the containers are dispensed and in which they can be mixed together. The substances contained in the containers have different colors, the dispenser includes at least one stirrer that is movable in said mixing chamber, and the mixing chamber is organized to enable the user to observe the color of the resulting mixture prior to extracting it.

54 Claims, 10 Drawing Sheets

PORTABLE DISPENSER FOR PACKAGING AND DISPENSING COLORED COSMETICS

The present invention relates to the field of devices for packaging and dispensing colored cosmetics, in particular foundation makeup.

BACKGROUND OF THE INVENTION

There exists a need for a portable dispenser that makes it possible for a user to make up a desired foundation by mixing substances of different colors contained in respective containers inside the dispenser.

OBJECTS AND SUMMARY OF THE INVENTION

The dispenser of the invention is of the type comprising a portable dispenser having at least two containers organized to enable the substances they contain to be dispensed in proportions selected by the user, and a mixing chamber into which the substances contained in the containers are dispensed and in which they can be mixed together. The substances contained in the containers have different colors, the dispenser includes at least one stirrer that is movable in said mixing chamber, and the mixing chamber is organized to enable the user to observe the color of the resulting mixture prior to extracting it.

By means of the invention, the user can dispense certain quantities of the substances contained in the containers into the mixing chamber and can homogenize the content of the mixing chamber by means of the stirrer.

Since the color of the resulting mixture is visible from the outside, the user can at all times add a new quantity of any one of the substances contained in the containers in order to change the color of the mixture if it is not suitable.

A dispenser having at least two containers organized to dispense the substances contained therein in selective proportions, and a mixing chamber within which the substances dispensed from the containers are mixed, is already known, e.g. from patent U.S. Pat. No. 4,893,729. That dispenser is designed to contain sun creams, and is not suitable for dispensing substances of different colors, and the user cannot observe the color of the resulting mixture until it comes out from the dispenser, and in addition the dispenser does not have a stirrer enabling the content of the mixing chamber to be homogenized before it is extracted.

In a particular embodiment, the mixing chamber is defined at least in part by a wall made of a transparent material. This makes it easy for the user to see the color of the mixture through said wall and to make adjustments, where necessary.

In particular embodiment, the stirrer has a control rod. This control rod can be actuated by the user in order to homogenize the content of the mixing chamber.

Advantageously, the stirrer is movable axially along the axis of the control rod and is movable in rotation about the axis of the control rod.

In a particular embodiment, the dispenser includes a piston enabling the substance contained in the mixing chamber to be dispensed. The piston can be movable relative to the container and it may be provided with first fastener means, the stirrer being provided with second fastener means organized to co-operate with said first fastener means in order to enable the stirrer and the piston to be coupled together after the substances contained in the mixing chamber have been mixed together and to make use of the displacement of the stirrer to drive the piston and dispense the mixture. The coupling between the stirrer and the piston can take place, for example, by virtue of the fact that the stirrer is movable in rotation about the axis of the control rod.

The above-mentioned first fastener means can be in the form of studs each comprising a body and a larger head, and the second fastener means can be in the form of respective slots each having an opening at one end of a size that is sufficient to enable the head of a stud to pass therethrough when the stirrer is moved axially, and a narrow opening in which the body of a stud can be engaged when the stirrer is rotated about the axis X, said narrow opening being narrower than the head of the associated stud so as to enable the stirrer and the piston to be driven together in axial displacement.

Advantageously, the stirrer comprises a perforated disk.

In a particular embodiment, the mixing chamber communicates with a dispenser endpiece fitted with a valve rated to open when the volume of the mixing chamber decreases.

In a particular embodiment, it includes a selector having at least two ports, capable of taking up a first position in which the mixing chamber communicates with one of the containers, and a second position in which the mixing chamber communicates with another container, and also a third position in which the mixing chamber is isolated from the containers.

In a particular embodiment, the selector can be in the form of a cover capable of turning relative to the body of the above-mentioned housing.

Advantageously, the mixing chamber is permanently in communication with the dispenser endpiece, said endpiece being fitted with a valve which opens only when the volume of the mixing chamber decreases and the selector is in its third position.

In a particular embodiment, the containers are fitted with pistons enabling said substances to be delivered into the mixing chamber.

Advantageously, the containers and the mixing chamber are situated in a housing whose body is made at least in part out of a transparent material, thereby enabling the user to see the color of the mixture before taking it.

In a particular embodiment, the mixing chamber is defined by a dispenser head slidably mounted relative to a piston, the piston being fixed relative to the container. The dispenser head can be raised while filling the mixing chamber, and can be moved in the opposite direction to dispense the content of the mixing chamber.

In a particular embodiment, each of the containers contains a piston that is prevented from moving by friction, the friction forces being sufficient to ensure that a piston does not move in its container when the volume of the mixing chamber is decreased for the purpose of dispensing the resulting mixture.

In a particular embodiment, the dispensor includes a pressurization member to be actuated for the purpose of establishing excess pressure on the outside faces of the pistons contained in the containers so as to force them to advance. The pressurizing member may comprise a bellows and a valve enabling air to be pumped. The dispenser may also have a flow restrictor member enabling adjustable head loss to be inserted between the pressurization member and the outside face of a piston in order to alter its speed of advance in the container when the pressurization member is actuated. This flow restrictor member can comprise a rotary disk having through orifices of increasing section enabling different head losses to be inserted. The pressurization member is advantageously organized to be capable of simultaneously applying excess pressure against the outside faces of all of the pistons of the containers.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
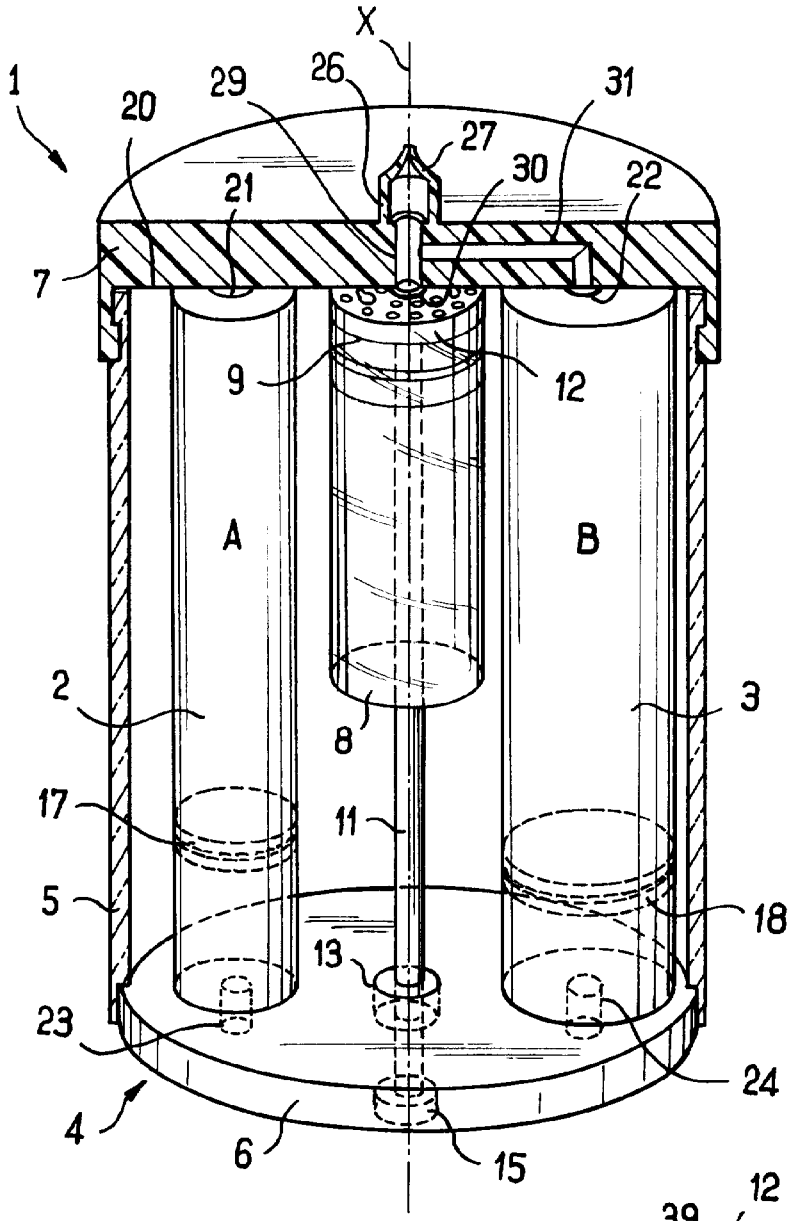
FIG. 1 is a partially cutaway diagrammatic perspective view of a dispenser constituting a first embodiment of the invention.

The dispenser 1 shown diagrammatically in FIG. 1 has two cylindrical containers 2, 3 contained inside a housing 4 of elongate shape having a longitudinal axis X.

The housing 4 comprises a circularly cylindrical body 5 about the axis X which is made in this embodiment out of a transparent plastics material, and it is closed at its bottom end by a bottom plate 6, and at its top end by a rotary cover 7.

The dispenser 1 also includes, between the containers 2 and 3, a cylindrical wall 8 about the axis X and made of a transparent plastics material, thereby defining a mixing chamber 42 whose purpose is described in greater detail below.

A piston 9 is mounted with the ability to slide in sealed manner inside the cylindrical wall 8. The top end of the cylindrical wall is closed by a wall extending perpendicularly to the axis X, and is pierced in its center by an opening 30 on the axis X which opens out in sealed manner to the bottom face 20 of the cover 7.

Figure 2:
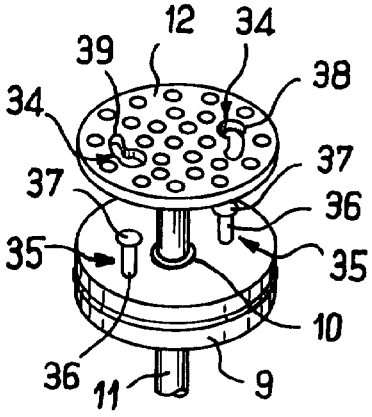

As can be seen in FIG. 2, in particular, the center of the piston 9 is pierced by an opening 10 on the axis X enabling a control rod 11 to pass therethrough, the top end of the control rod being secured to a stirrer comprising a perforated plate 12 whose function is described in greater detail below. Sealing means (not shown) are provided to enable the control rod 11 to pass in sealed manner through the piston 9.

In the example described, the length of the control rod 11 is greater than the length of the body 5 of the housing 4, and the bottom end of the control rod 11 passes through the bottom plate 6 via an opening 13.

The control rod 11 is provided at its bottom end with a head 15 for being grasped by a user.

Pistons 17 and 18 are mounted to slide in sealed manner in each of the containers 2 and 3 respectively.

In the embodiment described, the containers 2 and 3 are fixed at their bottom ends to the bottom plate 6, and they have walls perpendicular to the axis X at their top ends, which walls are pierced by respective openings 21 and 22 which open out in leakproof manner into the bottom face 20 of the cover 7.

Vents 23 and 24 are formed through the bottom plate 6 to allow pressure inside the containers 2 and 3 to be balanced adjacent to the bottom faces of the pistons 17 and 18.

The cylindrical wall 8 is secured to support means (not shown in order to clarify the drawing) which serve to hold it stationary inside the housing 4.

The outside face of the cover 7 has a dispenser endpiece 26 on the axis X and provided with an elastomer valve 27 which is closed at rest and which opens when the pressure of the substance contained inside the mixing chamber 42 exceeds a predetermined value.

The dispenser endpiece 26 communicates via a channel 29 that opens out into the mixing chamber 42 via above-mentioned opening 30.

An inside channel 31 having one end opening out into the channel 29 and its opposite end opening out to the bottom face 20 of the cover 7 enables the opening 21 or 22 of container 2 or 3 to be put into communication selectively with the mixing chamber 42 in a manner that is described in greater detail below.

The perforated disk 12 of the stirrer has numerous holes 33 as can be seen in FIG. 2 for the purpose of stirring the content of the mixing chamber when the control rod 11 is moved axially.

The perforated disk 12 also has two slots 34 disposed symmetrically to each other about the axis X, and designed to co-operate with studs 35 projecting from the top face of the piston 9, the general shape of these studs 35 being that of the head of a nail, comprising a cylindrical body 36 and a head 37 of diameter that is greater than that of the body 36.

The control rod 11 is of circular section and the user can rotate the perforated disk 12 about the axis X.

Each of the slots 34 has a circular opening 38 of greater diameter than the heads 37 of the studs 35, each of said openings 38 running into an oblong opening 39 whose opposite sides are circular arcs centered on the axis X and which are spaced apart by a distance that is greater than the diameter of the body 36 of each stud 35, but smaller than the outside diameter of the head 37.

Figure 3:
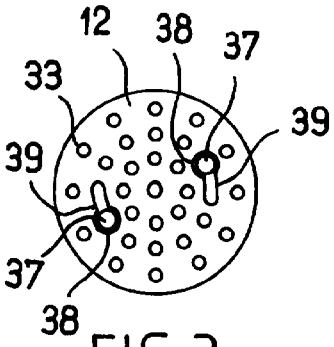
FIGS. 2 to 4 show the coupling between the stirrer and the piston.

FIG. 3 shows the heads 37 of the studs engaged through the circular openings 38.

Figure 4:
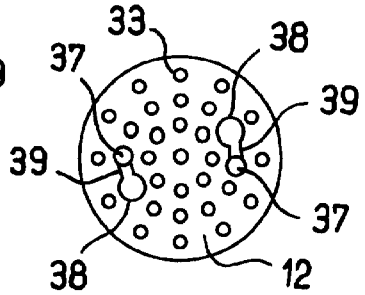

The bodies 36 of the studs 35 are of a height which is slightly greater than the thickness of the perforated disk 12 so that after the studs 35 have been engaged in the circular openings 38, the user can turn the control rod 11, thereby engaging the oblong openings 39 on the bodies 36 of the studs and thus secure the piston 9 axially to the stirrer, as shown in FIG. 4.

Figure 5:
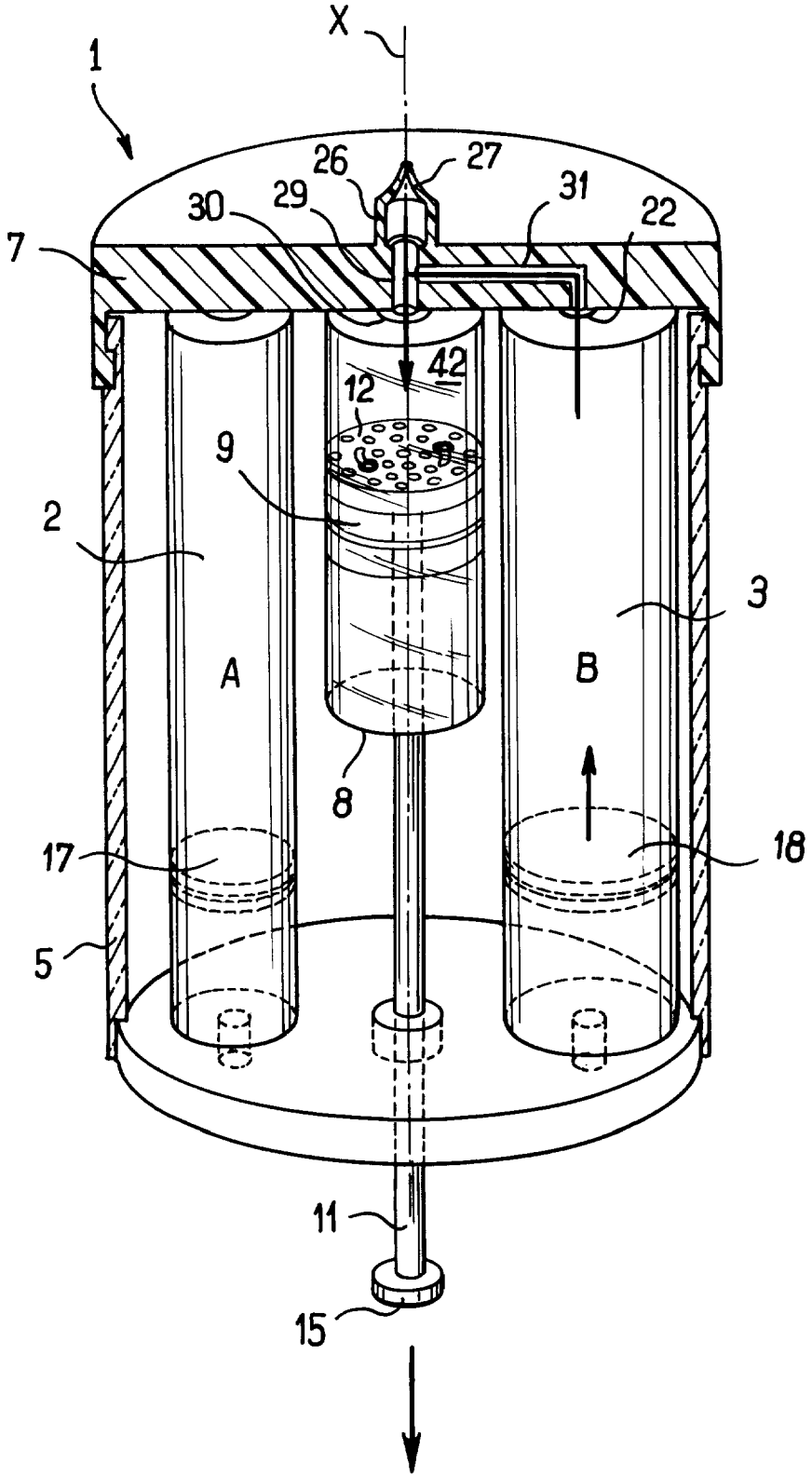
FIG. 5 shows the mixing chamber being filled with a first substance.

In order to use the dispenser 1, the user begins by filling the mixing chamber 42, e.g. with substance B from the container 3, with the cover 7 being positioned relative to the body 5 of the housing 4 in such a manner that the channel 31 puts the container 3 into communication with the inside of the cylindrical wall 8 above the piston 9, as shown in FIG. 5.

Substance B is sucked into the mixing chamber 42 by pulling on the control rod 11.

Figure 6:
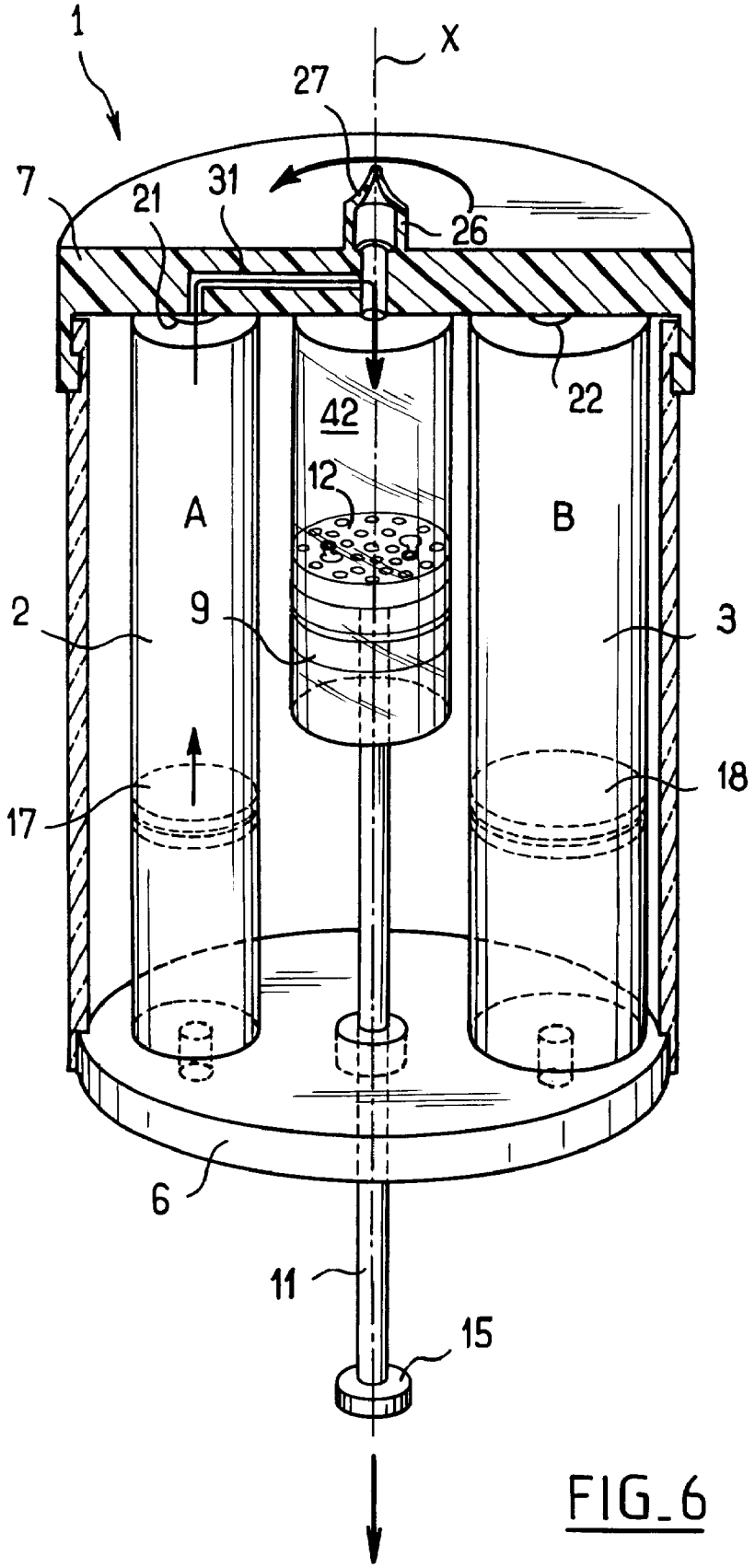
FIG. 6 shows further filling of the mixing chamber with a second substance.

After a desired quantity of substance B has been extracted, the user turns the cover 7 through 180° about the axis X as shown in FIG. 6 so as to put the container 2 into communication with the mixing chamber 42 via the channel 31.

The user can then suck a desired quantity of substance A into the mixing chamber 42. The cover 7 is thus used as a selector.

Figure 7:
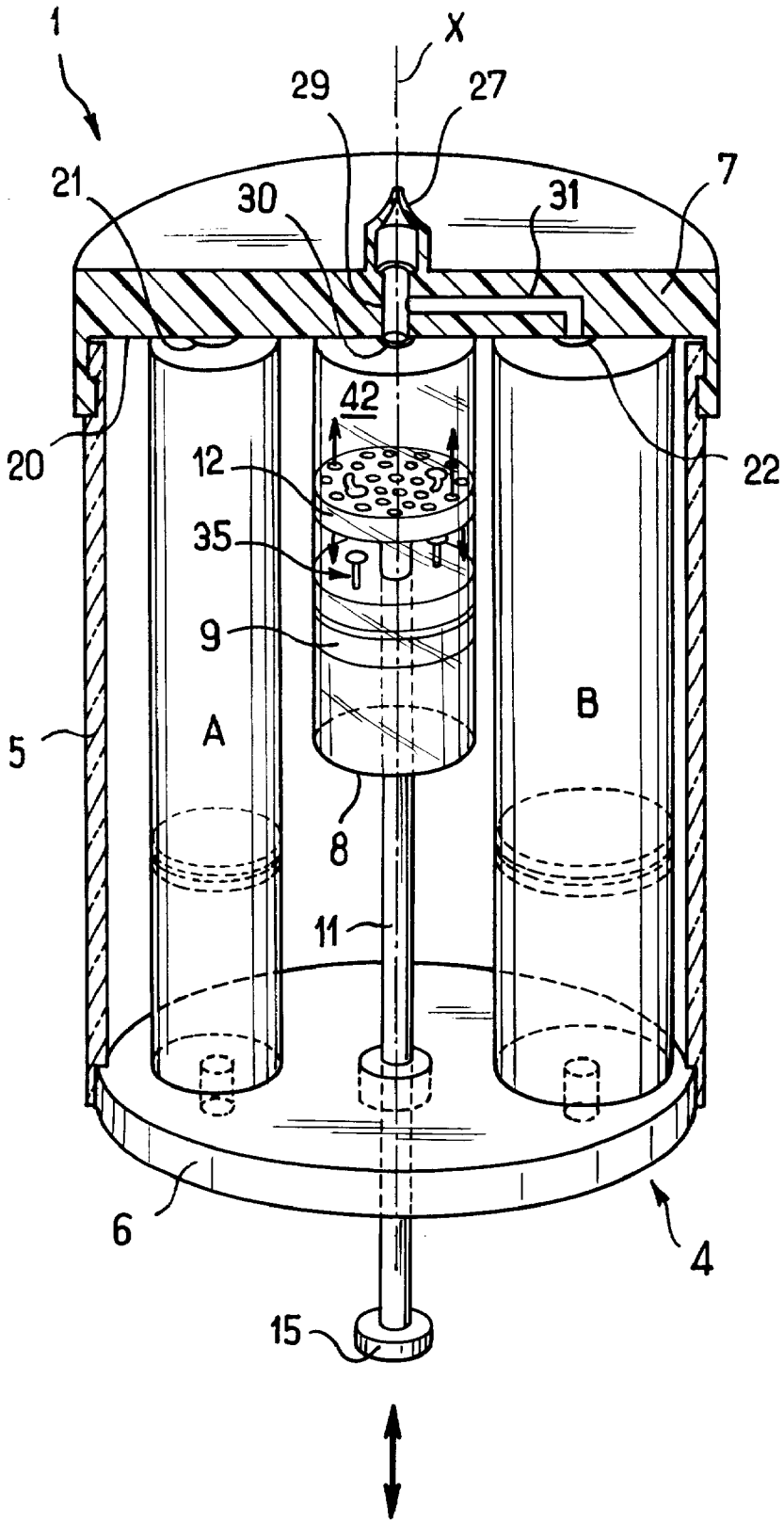
FIG. 7 shows the content of the mixing chamber being homogenized by means of the stirrer.

Once the mixing chamber 42 has been filled, the user can homogenize its content by performing small back-and-forth movements with the control rod 11, as shown in FIG. 7.

At all times, the user can see the color of the resulting mixture because the body 5 of the housing and the cylindrical wall 8 are made of transparent materials.

If the user sees that the color is not the color desired, it is possible, for example, to add a small quantity of substance B or substance A by positioning the selector cover 7 appropriately, and then by pulling on the control rod 11 to suck in an additional quantity of substance into the mixing chamber 42.

To dispense the mixture once the desired color has been obtained, the user positions the cover 7 in an intermediate position in which both containers 2 and 3 are isolated from the channel 29, both openings 21 and 22 then being closed by the bottom face 20 of the cover 7.

The user then couples together the perforated disk 12 and the piston 9 by proceeding as shown in FIGS. 3 and 4.

Then, when the user pushes in the control rod 11, the piston 9 accompanies the displacement of the perforated disk 12 so the content of the mixing chamber 42 is compressed.

Figure 8:
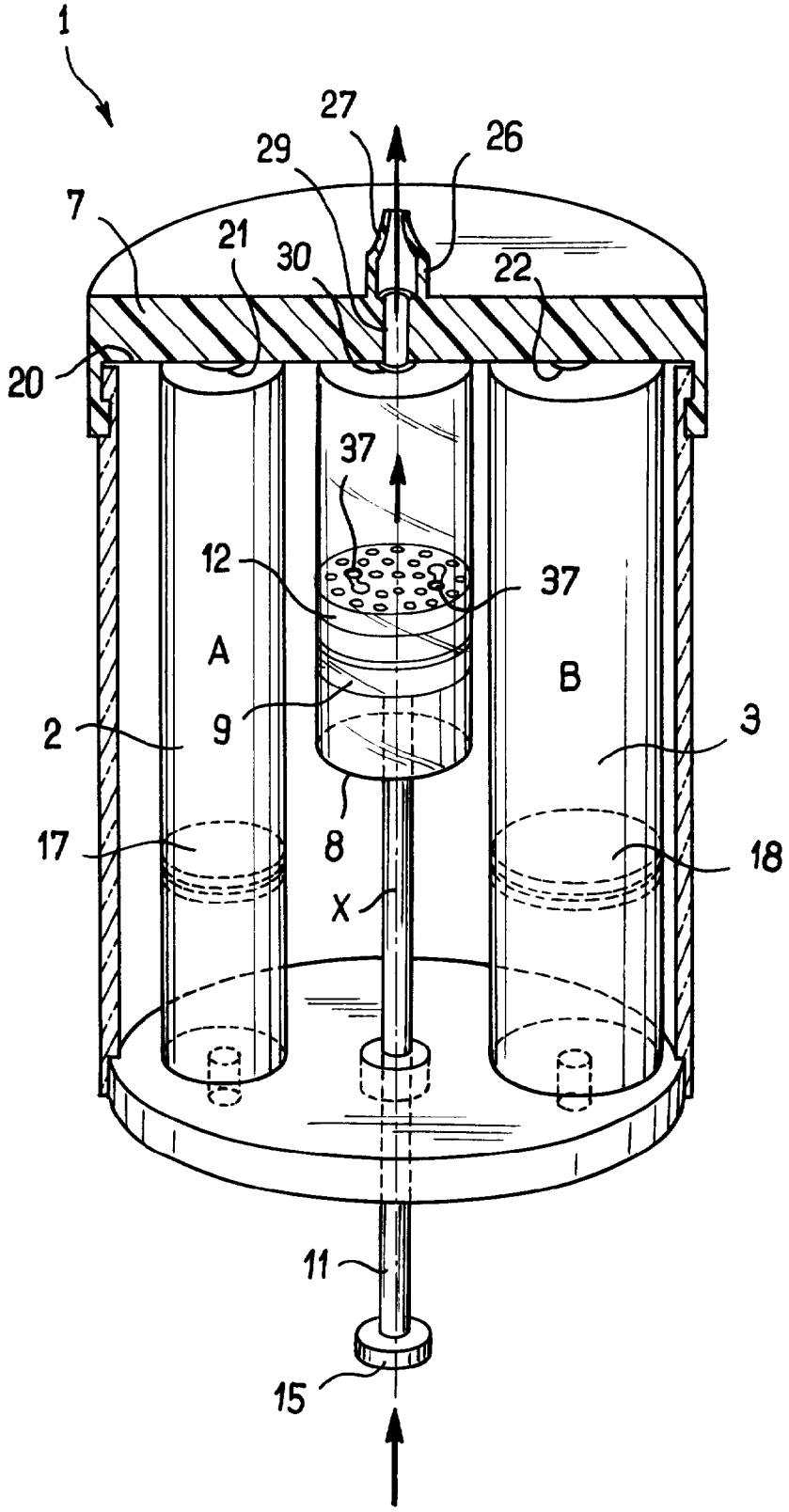
FIG. 8 shows the resulting mixture being dispensed.

The valve 27 is then subjected to the pressure from the substance contained in the mixing chamber 42, as shown in FIG. 8.

Figure 9:
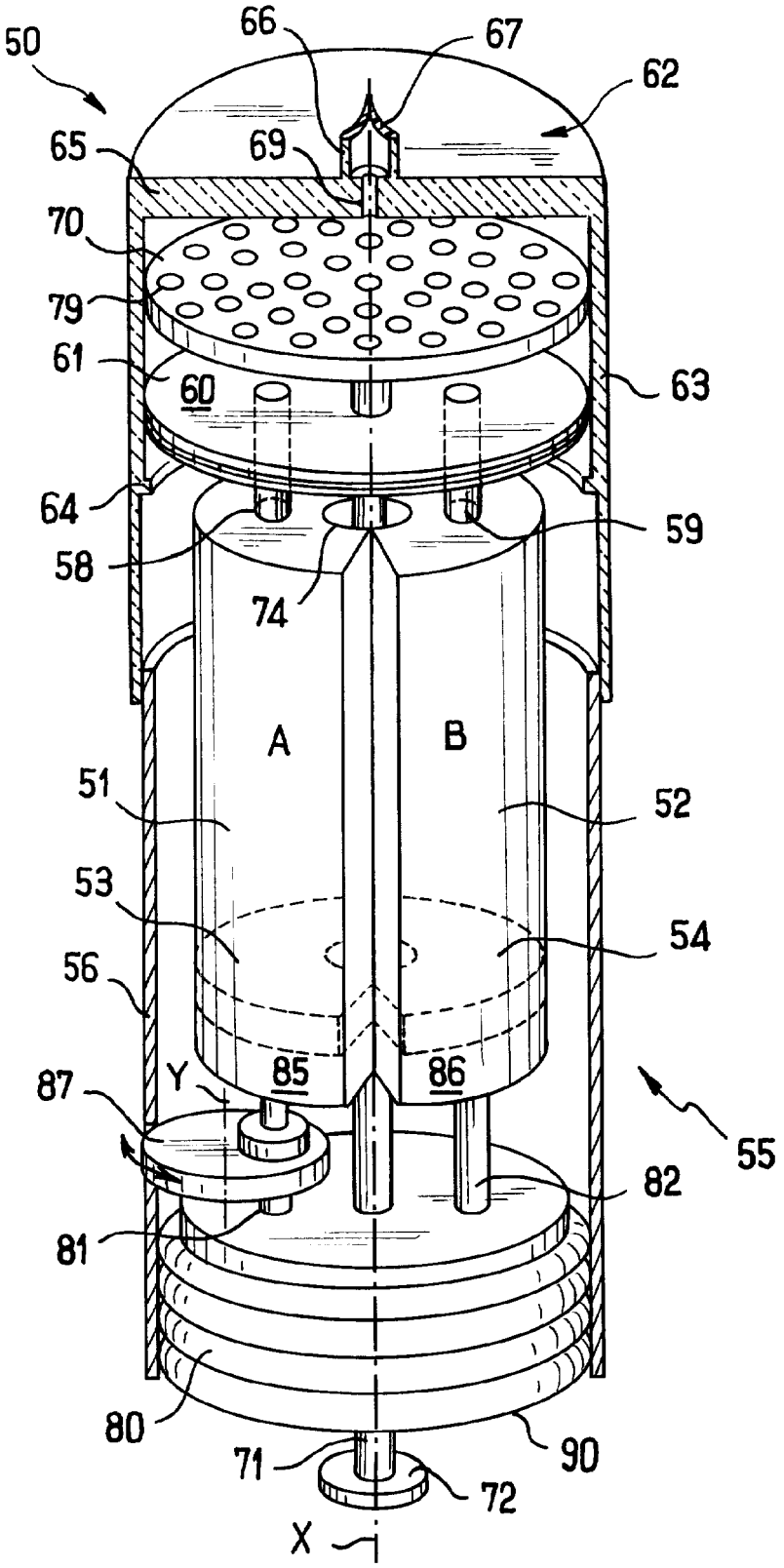
FIG. 9 is partially cutaway diagrammatic perspective view of a dispenser constituting a second embodiment of the invention.

FIG. 9 shows a dispenser 50 constituting a second embodiment of the invention.

This dispenser 50 has two semi-cylindrical containers 51 and 52 respectively containing substances A and B of different colors. Respective pistons 53 and 54 can slide in sealed manner in the containers 51 and 52.

The dispenser 50 has a housing 55 within which the containers 51 and 52 are fixed, said housing 55 comprising a body 56 that is circularly cylindrical about the axis X.

At its top, each of the containers 51 and 52 opens out via a respective duct 58 or 59 into a mixing chamber 60.

The bottom of the mixing chamber 60 is defined by a piston 61 on which the tubular skirt 63 of a dispenser head 62 slides in leakproof manner. The tubular skirt 63 is circularly symmetrical about the axis X and it is closed at its top end by a front wall 65 extending perpendicularly to the axis X.

The piston 61 is fixed relative to the body 56 of the housing 55 by support means that are not shown in order to avoid overcrowding the drawing.

The ducts 58 and 59 pass through the piston 61 in leakproof manner and open out to the top face of the piston 61 inside the mixing chamber 60.

The inside surface of the tubular skirt 63 has an annular rib 64 serving to limit the upward displacement stroke of the dispenser head 62 by coming into abutment against the bottom edge of the piston 61.

The top wall 65 of the dispenser head 62 is surmounted by a dispenser endpiece 66 which is closed at rest by a valve 67, the inside of the endpiece 66 being in communication with the mixing chamber 60 via a channel 69 on the axis X.

A stirrer comprising a perforated disk 70 having a plurality of perforations 79 is movable relative to the dispenser head 62, said perforated disk 70 being capable of being displaced axially between the front wall 65 and the piston 61.

The stirrer also has a control rod 71 passing in sealed manner through the piston 61 and provided at its bottom end with a head 72 for making it easier for a user to grasp it, and it is secured at its top end to the perforated disk 70.

In the example described, the containers 51 and 52 are side by side while leaving an axial passage 74 between them for passing the control rod 71.

Various drive means can be used for causing the pistons 53 and 53 to advance within the corresponding containers 51 and 52 for the purpose of dispensing substances A and B into the mixing chamber 60.

In the example shown, a pressurization member is used that comprises a bellows 80 and a valve (not shown).

The inside of the bellows 80 communicates via respective ducts 81 and 82 with the spaces 85 and 86 that extend inside the containers 51 and 52 beneath the pistons 53 and 54.

An adjustment member 87 is in the form of a knob that rotates about an axis Y parallel to the axis X and it serves to establish head loss and cause the piston 53 to advance to a greater or lesser extent relative to the piston 54 in order to dispense substance A to a greater or lesser extent relative to substance B while the mixing chamber 60 is being filled.

Figure 14:
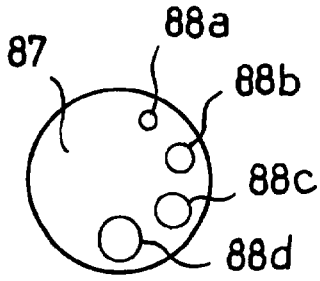
FIG. 14 is a front view of the flow restrictor member.
Figure 11:
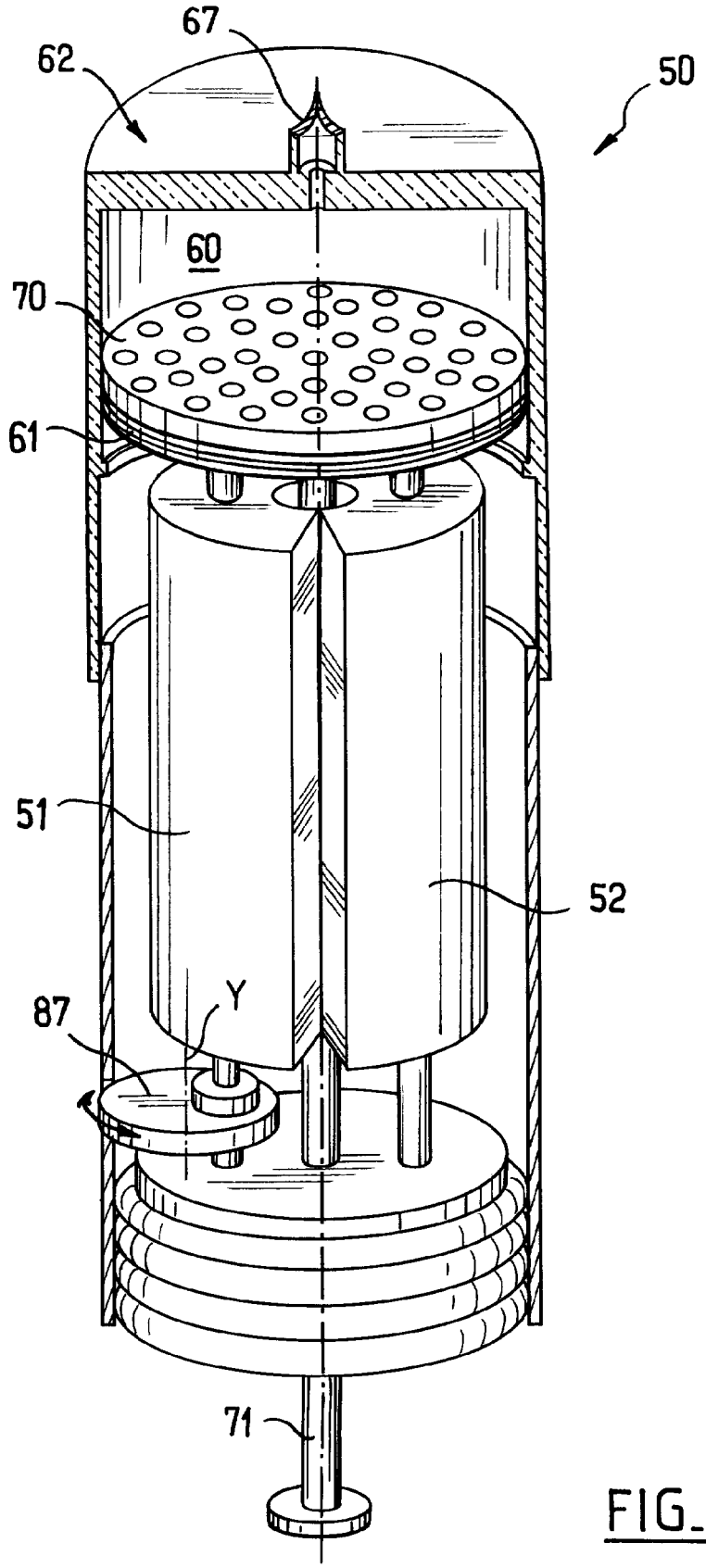
FIG. 11 shows the dispenser after the mixing chamber has been filled.
Figure 12:
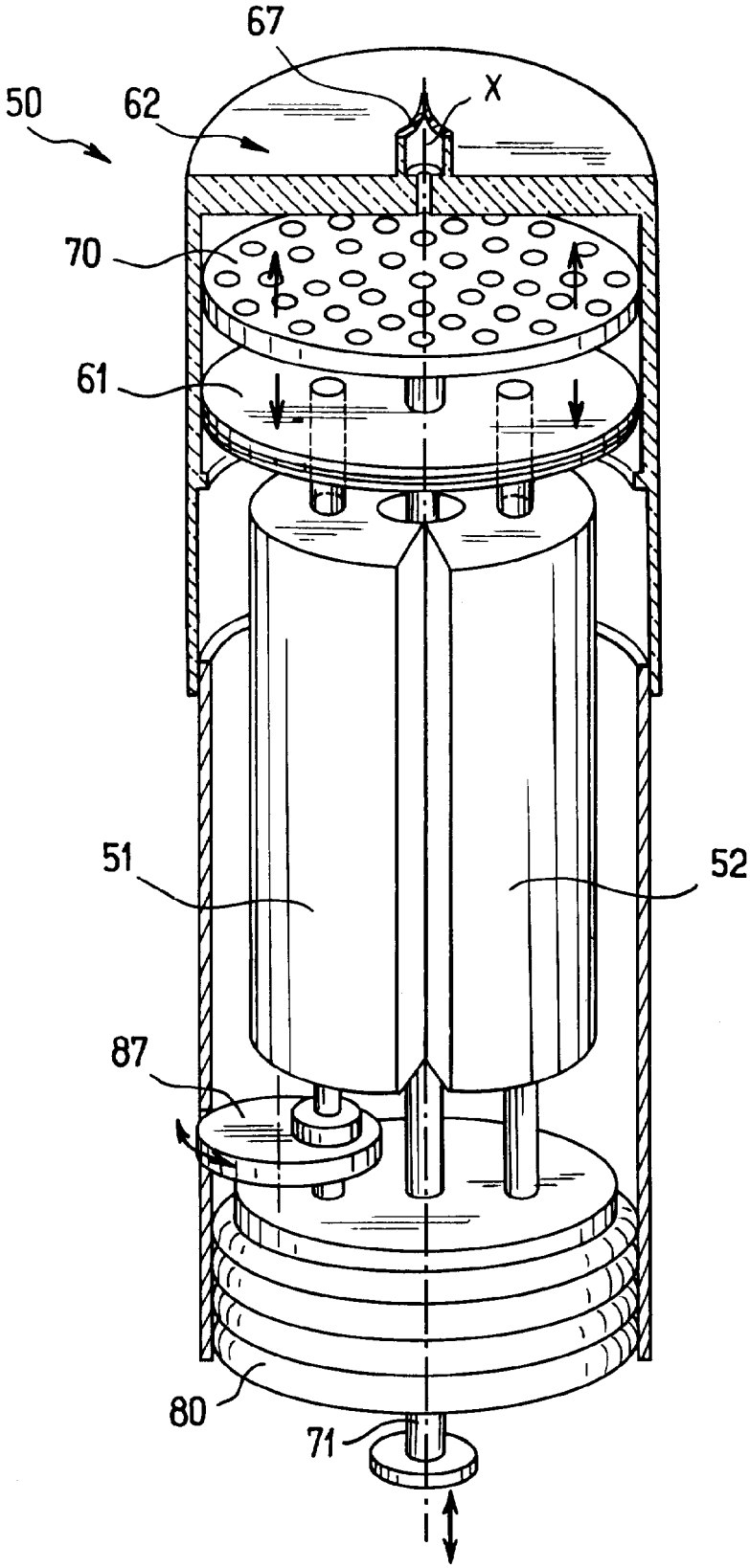
FIG. 12 shows the dispenser while the content of the mixing chamber is being homogenized.

As can be seen in FIG. 14, the knob 87 is provided with a plurality of flow-restricting orifices 88*a*, 88*b*, 88*c*, and 88*d* of increasing section, serving to introduce various amounts of head loss between the container 51 and the bellows 80, or indeed to isolate the bellows from the container 51.

The control rod 71 passes in leakproof manner through the bellows 80.

To dispense the substances A and B into the mixing chamber 60, the user actuates the bellows 80 by pressing against its bottom face 90 several times over so as to pump air and build up excess pressure inside the containers 51 and 52 beneath the pistons 53 and 54.

Under the effect of the excess pressure created by acting on the bellows 80, the pistons 53 and 54 rise inside the containers 51 and 52.

The extent to which the piston 53 rises is greater or smaller depending on the position of the knob 87.

Figure 10:
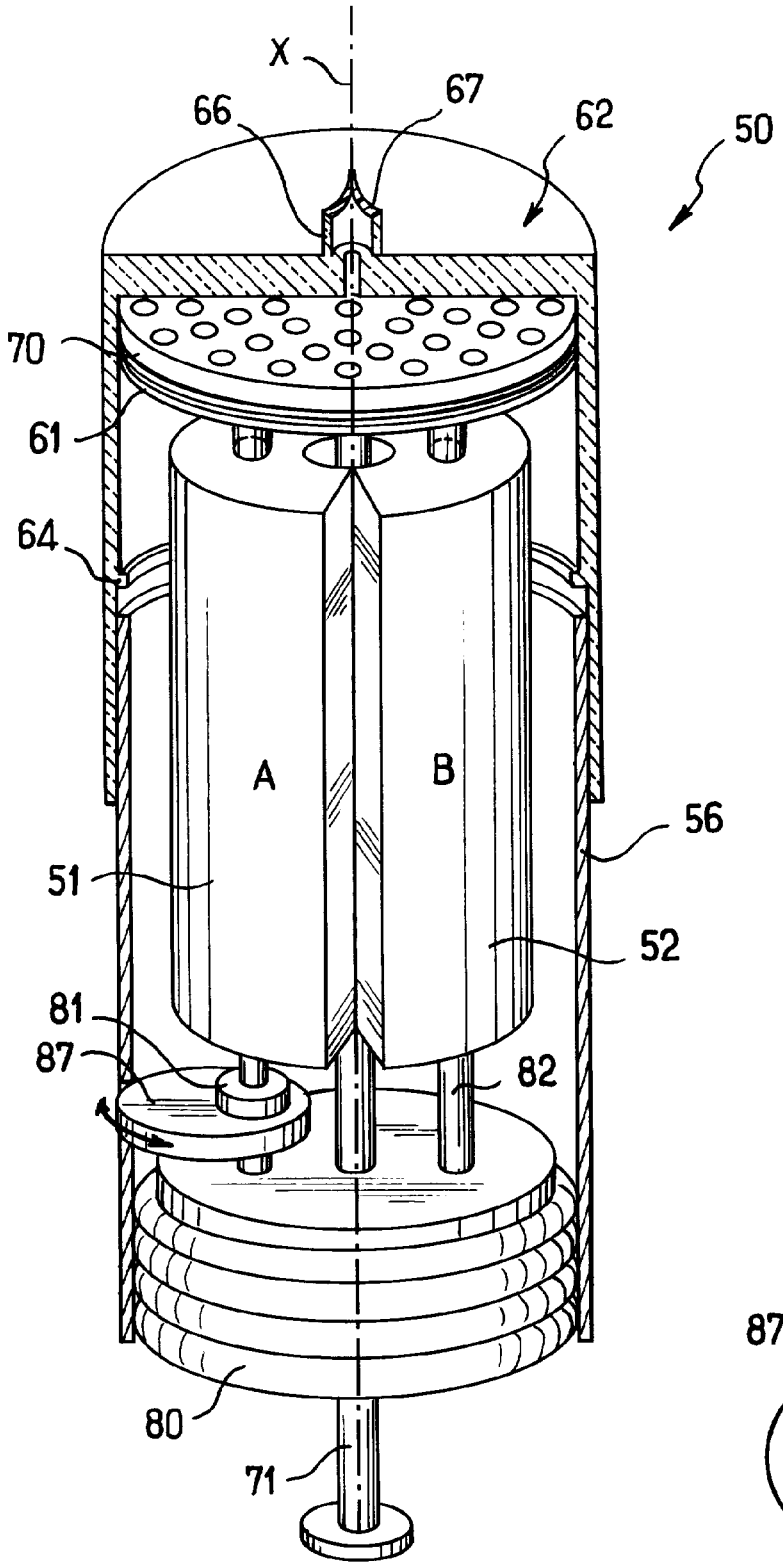
FIG. 10 shows the dispenser in its initial position.

While the mixing chamber 60 is being filled, the dispenser head 62 rises from its initial low position as shown in FIG. 10.

Once the desired quantity of substances A and B have been dispensed into the mixing chamber 60, the user can actuate the control rod 71 to move the perforated disk 70 inside the mixing chamber 60 and homogenize its content.

The valve 67 is organized in such a manner that it does not open while the dispenser head 62 is rising under the effect of the substances A and B flowing into the mixing chamber 60.

If the user observes that the resulting mixture does not have the desired color, then the setting of the knob 87 can be changed and new greater or smaller quantities of substance A or B can be dispensed in order to correct the color.

A second knob (not shown) can be provided to introduce a greater or smaller head loss in the path for air penetrating into the container 52, or indeed for isolating the container 52 from the bellows 80.

Figure 13:
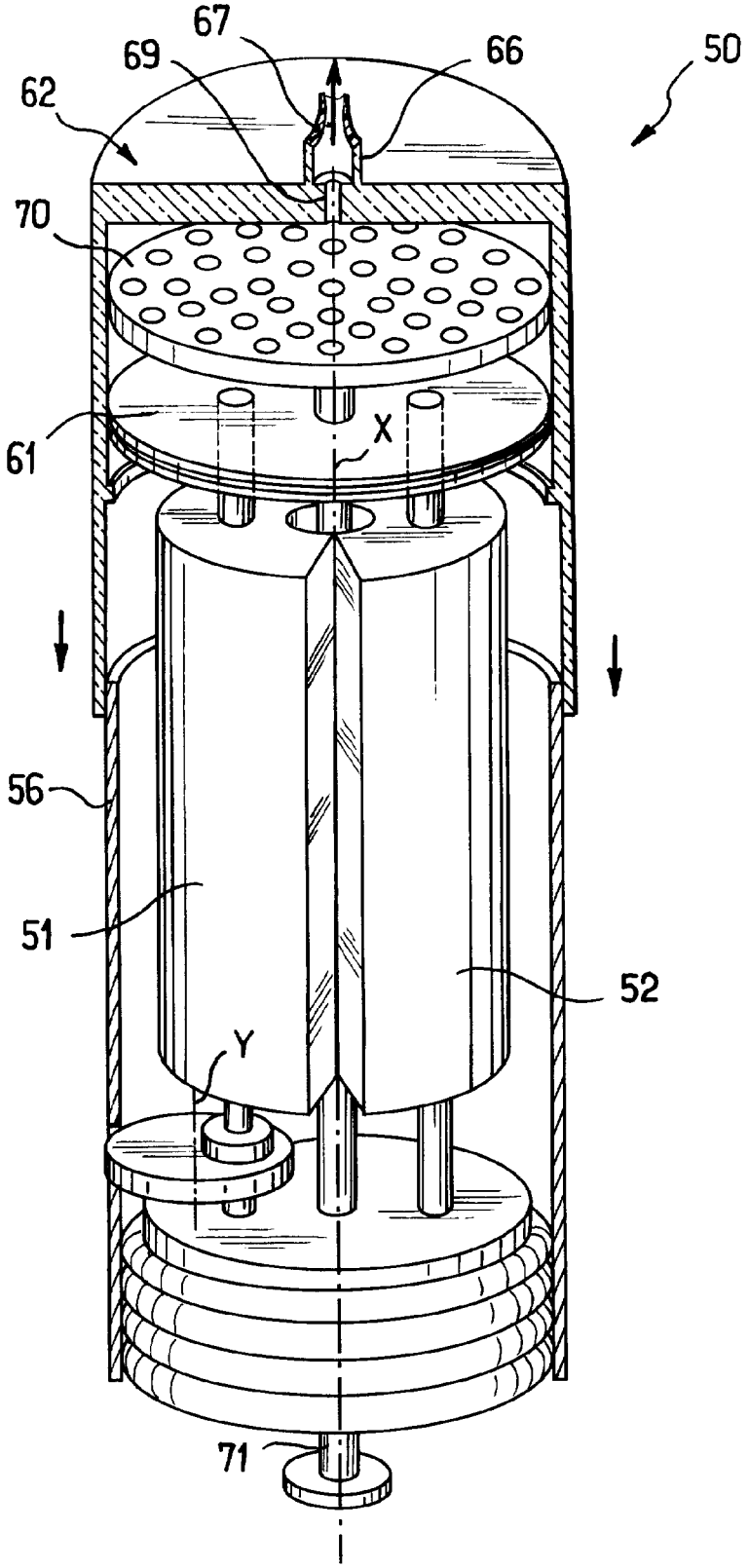
FIG. 13 shows the dispenser while the content of the mixing chamber is being dispensed.

In order to dispense the mixture, the user presses on the dispenser head 62 so as to move it downwards as shown in FIG. 13. While this is taking place, the valve 67 opens under the pressure from the substance, given that the pistons 53 and 54 are mounted with sufficient friction inside the containers 51 and 52 to avoid being displaced when the dispenser head 62 is pushed down.

Naturally, the invention is not limited to the embodiments described above.

In particular, other drive means can be used for moving the pistons inside the containers containing the substances that have different colors.

It also possible to use containers that do not have pistons, but that have walls which are deformable, with substance being dispensed into the mixing chamber by pressing on the walls of the containers, in which case the substance can be dispensed into the mixing chamber from each of the containers via a one-way dispenser member.

What is claimed is:

1. A portable dispenser, comprising at least two containers filled with substances of different colors;

a mixing chamber attached to the dispenser and into which the substances contained in the containers are dispensed and in which the substances can be mixed together to form a cosmetic composition; and at least one stirrer that is movable in said mixing chamber.

2. A dispenser according to claim 1, wherein the mixing chamber is defined at least in part by a wall made of a transparent material to enable a user to observe the color of a resulting mixture.

3. A dispenser according to claim 1, wherein the stirrer has a control rod.

4. A dispenser according to claim 3, wherein the stirrer is movable axially along an axis of the control rod and is movable in rotation about the axis of the control rod.

5. A dispenser according to claim 1, including a piston movable within the mixing chamber to vary the volume of said mixing chamber.

6. A dispenser according to claim 5, wherein the piston has a position relative to the containers and wherein said position can be modified by displacing the piston relative to the containers.

7. A dispenser according to claim 5, wherein the piston is provided with a first fastener and wherein the stirrer is provided with a second fastener capable of co-operating with said first fastener so as to enable the stirrer and the piston to be coupled together after the substances dispensed in the mixing chamber have been mixed together, and to enable the stirrer to drive the piston to distribute the mixture.

8. A dispenser according to claim 1, wherein the stirrer comprises a perforated disk.

9. A dispenser according to claim 1, wherein the mixing chamber communicates with a dispenser endpiece fitted with a valve which opens when dispensing the resulting mixture contained in the mixing chamber.

10. A dispenser according to claim 1, including a selector having at least one channel, the selector being capable of taking up a first position in which the mixing chamber communicates through said channel with one of the containers, and a second position in which the mixing chamber communication through said channel with another one of the containers, and a third position in which the mixing chamber is isolated from the containers, said first, second and third positions being selected by the user.

11. A dispenser according to claim 10, wherein the mixing chamber is permanently in communication with a dispenser endpiece, said dispenser endpiece being fitted with a valve which opens only when dispensing the resulting mixture contained in the mixing chamber and the selector is in the third position.

12. A dispenser according to claim 1, wherein each container is fitted with a respective piston enabling the substance contained therein to be dispensed into the mixing chamber.

13. A dispenser according to claim 1, wherein the containers and the mixing chamber are situated in a body which is made at least in part out of a transparent material.

14. A dispenser according to claim 13, wherein said containers and said mixing chamber are situated in a housing, wherein said housing is closed at its top end by a cover, and wherein said cover is capable of turning relative to said housing.

15. A dispenser according to claim 1, wherein the mixing chamber is defined by a dispenser head slidably mounted relative to a piston being engaged within said dispenser head, said piston being in a fixed position relative to the containers.

16. A dispenser according to claim 1, wherein each of the containers contains a piston that is prevented from moving by friction, the friction forces being sufficient to ensure that a piston does not move in an associated containers when dispensing the resulting mixture contained in the mixing chamber.

17. A dispenser according to claim 16, including a pressurization member connected to the containers, said pressurization member being actuated for establishing excess pressure on outside faces of the pistons contained in the containers, so as to force the outside faces to advance.

18. A dispenser according to claim 17, wherein said pressurization member comprises a bellows.

19. A dispenser according to claim 17, including a flow restrictor member enabling adjustable head loss to be inserted between the pressurization member and the outside face of one of the pistons so as to modify its rate of advance inside the container when the pressurization member is actuated.

20. A dispenser according to claim 1, wherein said containers are suitable to dispense the substances independently from each other in proportions selected by a user.

21. A dispenser according to claim 1, wherein said mixing chamber has a volume which can be decreased to dispense the resulting mixture contained in said mixing chamber.

22. A dispenser according to claim 1, wherein the dispenser is a hand-held portable dispenser.

23. A dispenser, comprising:

at least two containers filled with substances of different colors;

a mixing chamber secured to the containers and into which the substances contained in the containers can be dispensed in proportions selected by a user and in which the substances can be mixed together in order to form a cosmetic composition, wherein the mixing chamber is of a variable volume so as to, in response to a decrease of the volume, dispense the resulting mixture contained in the mixing chamber; and at least one stirrer that is movable in the mixing chamber.

24. A dispenser, comprising:

at least two containers filled with substances of different colors;

a mixing chamber into which the substances contained in the containers can be dispensed in proportions selected by a user and in which the substances can be mixed together in order to form a cosmetic composition, wherein the mixing chamber is of a variable volume so as to, in response to a decrease of said volume, dispense the resulting mixture contained in the mixing chamber;

wherein the resulting mixture is sealingly contained in the mixing chamber from the beginning of filling the mixing chamber until dispensing of the resulting mixture; and at least one stirrer that is movable in the mixing chamber.

25. A dispenser having at least two containers and a mixing chamber into which cosmetic substances of different colors contained in the containers are dispensed and in which the cosmetic substances can be mixed together, wherein the dispenser includes at least one stirrer that is movable in said mixing chamber, wherein said containers are suitable to dispense the cosmetic substances independently from each other in proportions selected by a user, wherein said mixing chamber is secured to said containers when dispensing the resulting mixture, and wherein the mixing chamber is defined at least in part by a wall made of a transparent material to enable the user to observe the color of the resulting mixture.

26. A dispenser according to claim 25, wherein the stirrer has a control rod.

27. A dispenser according to claim 26, wherein the stirrer is movable axially along an axis of the control rod and is movable in rotation about the axis of the control rod.

28. A dispenser according to claim 25, including a piston movable within the mixing chamber to vary the volume of said mixing chamber.

29. A dispenser according to claim 28, wherein the piston has a position relative to the containers and wherein the position can be modified by displacing the piston relative to the containers.

30. A dispenser according to claim 25, wherein the stirrer comprises a perforated disk.

31. A dispenser according to claim 25, wherein the mixing chamber communicates with a dispenser endpiece fitted with a valve that opens when dispensing the resulting mixture contained in the mixing chamber.

32. A dispenser according to claim 25, including a selector having at least one channel, the selector being capable of taking up a first position in which the mixing chamber communicates through the channel with one of the containers, and a second position in which the mixing chamber communicates through the channel with another one of the containers, and a third position in which the mixing chamber is isolated from the containers, said first, second and third positions being selected by the user.

33. A dispenser according to claim 25, wherein each container is fitted with a piston enabling the substance contained therein to be dispensed into the mixing chamber.

34. A dispenser according to claim 25, wherein the containers and the mixing chamber are situated in a body made at least in part of a transparent material.

35. A dispenser according to claim 25, wherein each of the containers contains a piston that is prevented from moving by friction, the friction forces being sufficient to ensure that the pistons do not move in the containers when dispensing the resulting mixture contained in the mixing chamber.

36. A dispenser according to claim 35, including a pressurization member connected to the containers, the pressurization member being actuated to establish excess pressure on outside faces of the pistons contained in the containers, so as to force the outside faces to advance.

37. A dispenser according to claim 25, wherein the mixing chamber has a volume that can be decreased to dispense the resulting mixture contained in the mixing chamber.

38. A dispenser comprising:

at least two containers filled with substances of different colors;

a mixing chamber into which the substances contained in the containers are dispensed and in which the substances can be mixed together;

at least one stirrer that is movable in said mixing chamber;

a piston that is movable within the mixing chamber to vary the volume of said mixing chamber;

wherein the piston is provided with a first fastener; and wherein the stirrer is provided with a second fastener capable of co-operating with the first fastener to enable the stirrer and the piston to be coupled together after the substances dispensed in the mixing chamber have been mixed together, and to enable the stirrer to drive the piston to distribute the mixture.

39. A dispenser according to claim 38, wherein the first fastener is in the form of studs each comprising a body and a larger head, wherein the second fastener is in the form of respective slots each having an opening at one end of a size that is sufficient to enable the head of a stud to pass therethrough when the stirrer is moved axially along an axis, and a narrow opening in which the body of a stud can be engaged when the stirrer is rotated about said axis, said narrow opening being narrower than the head of an associated stud so as to enable the stirrer and the piston to be driven together in axial displacement.

40. A dispenser according to claim 38, wherein the substances are mixed to form a cosmetic composition.

41. A dispenser comprising:

at least two containers filled with substances of different colors;

a mixing chamber into which the substances contained in the containers are dispensed and in which the substances can be mixed together;

at least one stirrer that is movable in the mixing chamber;

a selector having at least one channel, the selector being capable of taking up a first position in which the mixing chamber communicates through the channel with one of the containers, and a second position in which the mixing chamber communicates through the channel with another one of the containers, and a third position in which the mixing chamber is isolated from the containers, the first, second and third positions being selected by the user; and wherein the mixing chamber is permanently in communication with a dispenser endpiece, the dispenser endpiece being fitted with a valve which opens only when dispensing the resulting mixture contained in the mixing chamber and the selector is in the third position.

42. A dispenser according to claim 41, wherein the substances are mixed to form a cosmetic composition.

43. A dispenser comprising:

at least two containers filled with substances of different colors;

a mixing chamber into which the substances contained in the containers are dispensed and in which the substances can be mixed together;

at least one stirrer that is movable in the mixing chamber;

wherein the containers and the mixing chamber are situated in a body that is made, at least in part, of a transparent material;

wherein the containers and the mixing chamber are situated in a housing;

wherein the housing is closed at its top end by a cover; and wherein the cover is capable of turning relative to the housing.

44. A dispenser according to claim 43, wherein the substances are mixed to form a cosmetic composition.

45. A dispenser comprising:

at least two containers filled with substances of different colors;

a mixing chamber into which the substances contained in the containers are dispensed and in which the substances can be mixed together;

at least one stirrer that is movable in the mixing chamber; and wherein the mixing chamber is defined by a dispenser head slidably mounted relative to a piston, the piston being engaged within the dispenser head, the piston being in a fixed position relative to the containers.

46. A dispenser according to claim 45, wherein the dispenser head is allowed to rise while the mixing chamber is being filled.

47. A dispenser according to claim 45, wherein the substances are mixed to form a cosmetic composition.

48. A dispenser comprising:

at least two containers filled with substances of different colors;

a mixing chamber into which the substances contained in the containers are dispensed and in which the substances can be mixed together;

at least one stirrer that is movable in the mixing chamber;

wherein each of the containers contains a piston that is prevented from moving by friction forces, the friction forces being sufficient to ensure that each piston does not move in the associated container when dispensing the resulting mixture contained in the mixing chamber; and a pressurization member comprising a bellows connected to the containers, the pressurization member being actuated for establishing excess pressure on outside faces of the pistons contained in the containers, to force the outside faces to advance.

49. A dispenser according to claim 48, wherein the pressurization member is configured so as to apply excess pressure simultaneously to the outside faces of all the pistons of the containers.

50. A dispenser according to claim 48, wherein the substances are mixed to form a cosmetic composition.

51. A dispenser comprising:

at least two containers filled with substances of different colors;

a mixing chamber into which the substances contained in the containers are dispensed and in which the substances can be mixed together;

at least one stirrer that is movable in the mixing chamber;

wherein each of the containers contains a piston that is prevented from moving by friction forces, the friction forces being sufficient to ensure that each piston does not move in the associated container when dispensing the resulting mixture contained in the mixing chamber;

a pressurization member connected to the containers, the pressurization member being actuated to establish excess pressure on outside faces of the pistons contained in the containers, so as to force the outside faces to advance; and a flow restrictor member enabling adjustable head loss to be inserted between the pressurization member and the outside face of one of the pistons so as to modify the rate of advance of said one of the pistons inside the container when the pressurization member is actuated.

52. A dispenser according to claim 51, wherein said flow restrictor member comprises a disk having orifices of increasing section passing therethrough enabling different head losses to be introduced.

53. A dispenser according to claim 51, wherein the substances are mixed to form a cosmetic composition.

54. A portable dispenser comprising:

at least two containers filled with substances of different colors, at least one of the containers having a lower portion;

a mixing chamber into which the substances contained in the containers are dispensed and in which the substances can be mixed together in order to form a cosmetic composition; and at least one stirrer that is movable in the mixing chamber;

wherein the mixing chamber has at least one portion situated above the lower portion at least during the filling of the mixing chamber.

* * * * *